US005527255A

United States Patent [19]

Mansfield

[11] Patent Number: 5,527,255

[45] Date of Patent: Jun. 18, 1996

[54] APPARATUS AND METHOD FOR PREPARING DISPOSABLE TOWELS

[76] Inventor: Peter W. Mansfield, 511 59th St., Holmes Beach, Fla. 34217

[21] Appl. No.: 323,849

[22] Filed: Oct. 17, 1994

[51] Int. Cl.[6] ..... B65B 63/04; B31F 7/00

[52] U.S. Cl. ..... 493/327; 162/119; 162/135; 118/226; 68/222; 68/132; 8/151; 493/328; 493/329; 493/346; 493/381

[58] Field of Search ..... 162/119, 120, 162/135; 118/255, 96, 40, 602, 114, 32, 226; 68/222, 132; 8/151; 53/431, 429, 520, 111 RC; 493/326, 327, 328, 329, 340, 346, 380, 381, 336

[56] References Cited

U.S. PATENT DOCUMENTS

| | | | |
|---|---|---|---|
| 1,564,674 | 12/1925 | Smith | 493/381 |
| 1,609,320 | 12/1926 | Smith | 493/381 |
| 1,986,954 | 1/1935 | Abrams et al. | 493/381 |
| 2,075,178 | 3/1937 | Copeman | 493/381 |
| 3,083,374 | 4/1963 | Watlington | 4/1 |
| 3,346,893 | 10/1967 | Carpenter | 68/22 R |
| 3,349,580 | 10/1967 | Valls | 68/22 R |
| 3,495,571 | 2/1970 | Evans | 118/325 |
| 3,776,773 | 12/1973 | Taft | 134/6 |
| 3,786,615 | 1/1974 | Bauer | 53/429 |
| 3,803,798 | 4/1974 | Clancy | 53/120 |
| 3,875,769 | 4/1975 | Inoue | 68/22 R |
| 3,895,474 | 7/1975 | Bauer | 53/429 |
| 3,986,479 | 10/1976 | Bonk | 118/506 |
| 4,025,304 | 4/1977 | Fleissner | 8/151 |
| 4,136,538 | 1/1979 | Spear et al. | 68/22 R |
| 4,305,169 | 12/1981 | Vidalis | 8/149 |
| 4,313,899 | 2/1982 | Hain | 493/329 |
| 4,408,437 | 10/1983 | Crouch et al. | 53/520 |
| 4,418,433 | 12/1983 | Moreland et al. | 68/13 R |
| 4,447,924 | 5/1984 | Bolton et al. | 68/22 R |
| 4,546,624 | 10/1985 | von der Eltz et al. | 68/22 R |
| 4,627,936 | 12/1986 | Gould et al. | 252/558 |
| 4,666,621 | 5/1987 | Clark et al. | 252/91 |
| 4,709,606 | 12/1987 | Stemmier | 493/346 |
| 4,775,358 | 10/1988 | Jones | 493/346 |
| 4,798,574 | 1/1989 | Marsik | 493/329 |
| 4,817,790 | 4/1989 | Porat et al. | 206/205 |
| 4,833,748 | 5/1989 | Zimmer et al. | 8/151 |
| 4,931,035 | 6/1990 | Schmidt | 493/381 |
| 5,044,141 | 6/1991 | Franchi | 53/431 |
| 5,337,586 | 8/1994 | Ronchi | 68/22 R |
| 5,409,747 | 4/1995 | Pearlstein et al. | 428/34.2 |

*Primary Examiner*—Jack W. Lavinder
*Assistant Examiner*—Christopher W. Day
*Attorney, Agent, or Firm*—Charles J. Prescott

[57] ABSTRACT

An apparatus and a method of preparing stacks of individual wet, dripless disposable towels ready for sealed packing. The apparatus includes a creel for rollably supporting a plurality of continuous rolls of disposable towel stock material formed of non-woven cotton cloth and the like. The apparatus in step sequence includes a guide for merging each length of towel stock material together and edgewise aligned after being drawn from each roll to form a web. The web is then drawn through a flood box whereinto a suitable washing and/or dermicidal liquid is pumped to completely saturate the web to produce a liquid saturated web portion. A squeeze roller arrangement positioned immediately adjacent the flood box removes some of the liquid from the saturated wet portion to produce a wet, dripless web portion which uniformly contains a preselected liquid content, depending upon preselected tensioning of the rollers. A collecting tank positioned below the flood box and the squeeze rollers collects excess liquid. Thereafter, the wet, dripless web portion is drawn beyond a web cutter a distance generally equal to a length of said stacks, after which the web cutter is activated. The apparatus is incremental in operation, rather than continuous in feed.

4 Claims, 2 Drawing Sheets

APPARATUS AND METHOD FOR PREPARING DISPOSABLE TOWELS

BACKGROUND OF THE INVENTION

1. Scope of Invention

This invention relates generally to the preparation of moistened disposable towels or "towelettes", and more particularly to an apparatus and method of preparing stacks containing a plurality of premoistened disposable towels ready for sealed packaging.

2. Prior Art

The popularity of individually wrapped moistened disposable towels has increased steadily. These moistened disposable towels are available in conjunction with food consumption, baby care, hospital nursing care and the like. A single moistened towel folded into a compact configuration is marketed in individual sealed tearable packages.

Alternately, these moistened disposable towels are also marketed in larger containers, some of which serve as a dispenser as well as containing a supply of moistened towels. Such containers typically hold a large quantity of individually folded and stacked moistened towels which are accessible by removing a resealable lid from the container. Those containers which also sere as a dispenser are known to typically be of a cylindrical nature and containing a roll of disposable towel stock perforated regularly along the length thereof for easy detachment one at a time through a uniquely configured opening in the lid.

A need has developed in hospital and nursing care settings for a sealed package of a smaller quantity of moistened disposable towels having a count of between in the range of six to twelve individual disposable towels. Such a quantity of disposable towels has been found useful for patient bathing and cleanliness care wherein more than one disposable towel is required, yet a quantity of 50 to 100 disposable towels currently available would-be wasted.

The present invention provides an apparatus and a method for economically and efficiently preparing stacks of premoistened disposable towels uniformly cut in length and width and stacked atop one another in generally edge-aligned fashion ready for sealed packaging. The degree of moistening or liquid saturation of the towels is conveniently controlled, along with the makeup of the liquid impregnated or saturated into each disposable towel prior to cutting, stacking and packaging.

BRIEF SUMMARY OF THE INVENTION

This invention is directed to an apparatus and a method of preparing stacks of individual wet, dripless disposable towels ready for sealed packing. The apparatus includes a creel for rollably supporting a plurality of continuous rolls of disposable towel stock material formed of non-woven cotton cloth and the like. The apparatus in step sequence includes a guide for merging each length of towel stock material together and edgewise aligned after being drawn from each roll to form a web. The web is then drawn through a flood box whereinto a suitable washing and/or dermicidal liquid is pumped to completely saturate the web to produce a liquid saturated web portion. A squeeze roller arrangement positioned immediately adjacent the flood box removes some of the liquid from the saturated wet portion to produce a wet, dripless web portion which uniformly contains a preselected liquid content, depending upon preselected tensioning of the rollers. A collecting tank positioned below the flood box and the squeeze rollers collects excess liquid. Thereafter, the wet, dripless web portion is drawn beyond a web cutter a distance generally equal to a length of said stacks, after which the web cutter is activated. The apparatus is incremental in operation, rather than continuous in feed.

It is therefore an object of this invention to provide an apparatus for preparing stacks of individual liquid containing disposable towels ready for packaging.

It is yet another object of this invention to provide an apparatus for controlling both the liquid content and volume of liquid or degree of saturation contained within each of individual disposable towel of each stack ready for packaging.

It is yet another object of this invention to provide a method of producing stacks of individual wet, dripless disposable towels ready for sealed packaging.

It is yet another object of this invention to provide an apparatus for preparing stacks of wet, dripless, disposable towels which includes a precisely monitored fluid metering system for both economy and accuracy in controlling the degree of saturation.

In accordance with these and other objects which will become apparent hereinafter, the instant invention will now be described with reference to the accompanying drawings.

DETAILED DESCRIPTION OF THE INVENTION

Figure 1:
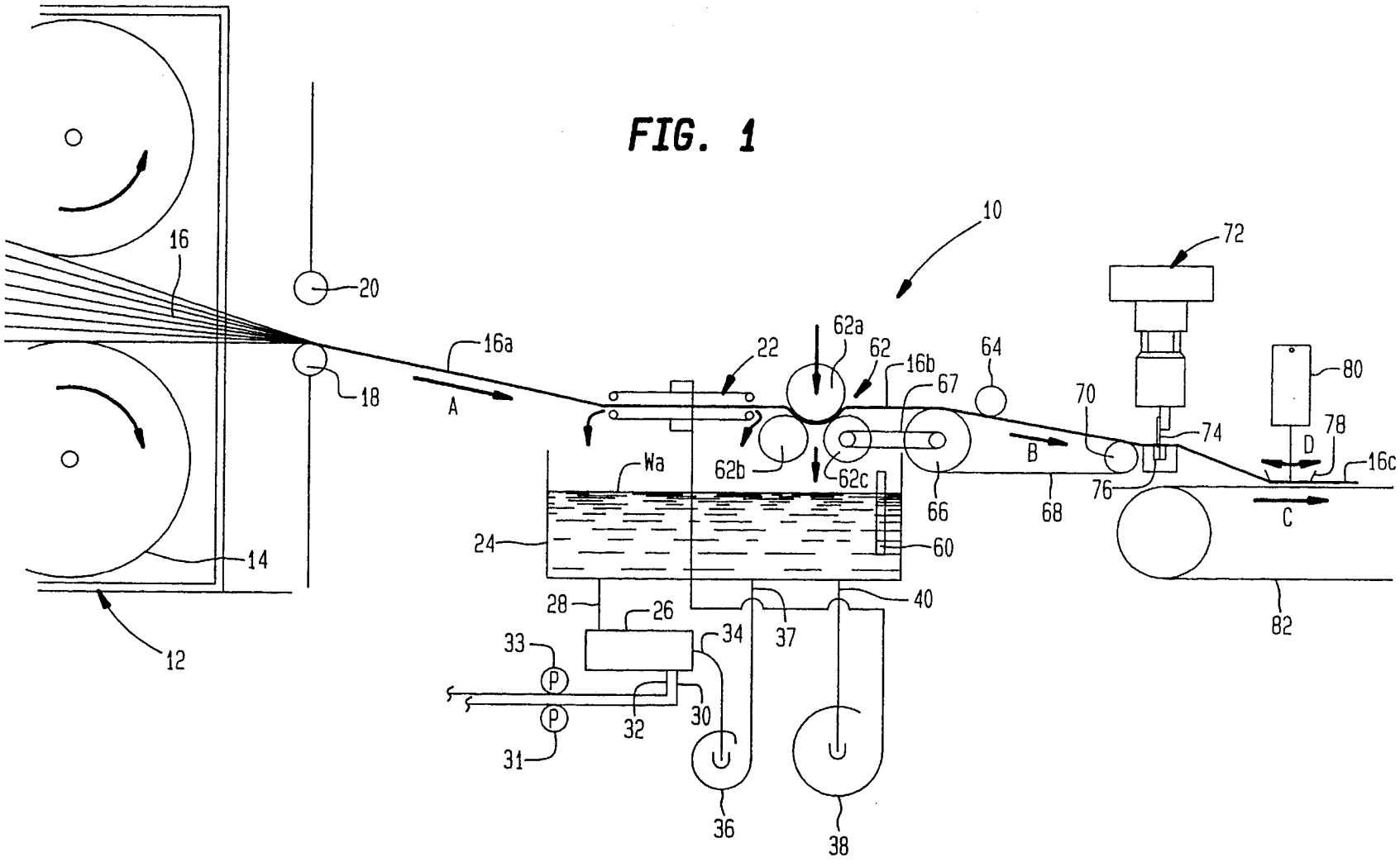
FIG. 1 is a side elevation schematic view of the invention.
Figure 3:
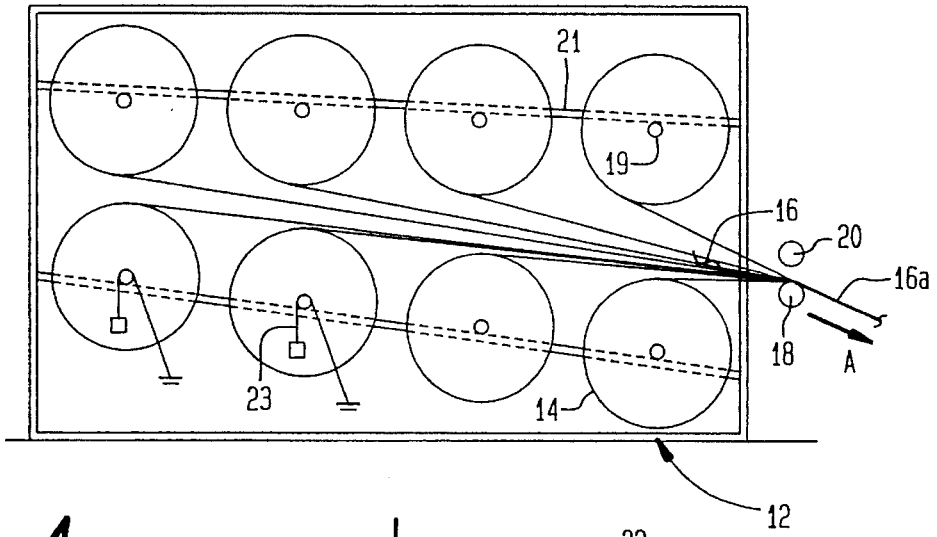
FIG. 3 is a side elevation schematic view of the entire creel of FIG. 1 which supports a plurality of rolls of unmoistened disposable continuous towel stock.

Referring now to the drawings, the invention is shown generally at numeral 10 and includes a creel 12 as best seen in FIGS. 1 and 3 for supporting a plurality of rolls of nonwoven cotton disposable towel stock 14. These towel stock rolls 14 are continuous without perforations and cut in preselected widths (preferably 9") equal to the desired width of the stacks of disposable towels ready for sealed packaging at the end of the manufacturing sequence.

The creel 12 includes a plurality of laterally disposed horizontally aligned creel pins 19 which are cantilever mounted to two longitudinally extending support members 21. By this arrangement, the free ends of each of the towel stock rolls 14 may be merged at 16 against one another between guides 18 and 20 to form a web **16*a* which is drawn in the direction of arrow A in FIGS. 1 and 3**.

To prevent overfeed, a friction brake 23, acting to resist free rolling of each of the towel stock rolls 14 is also provided.

Figure 2:
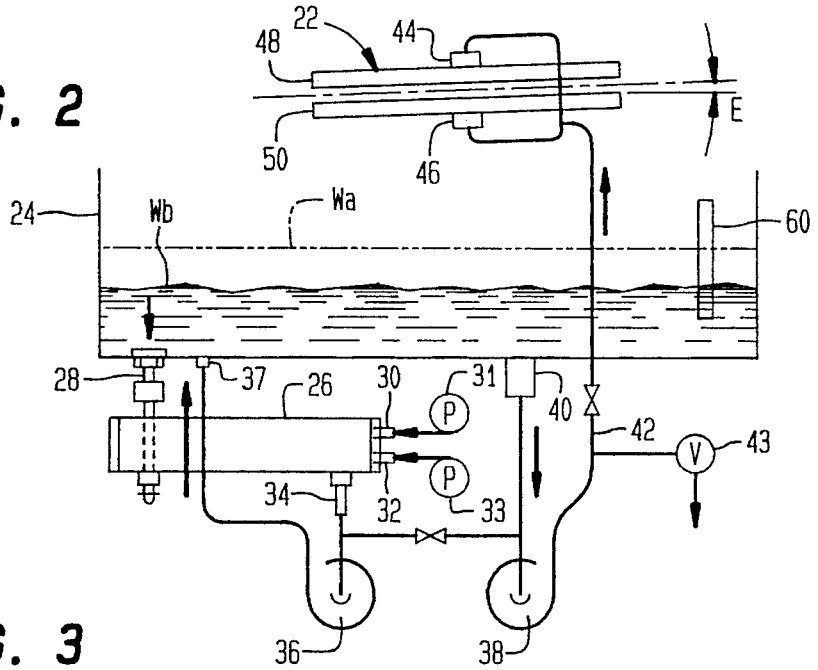
FIG. 2 is a side elevation schematic view of the flood box and liquid collecting tank shown in FIG. 1.
Figure 4:
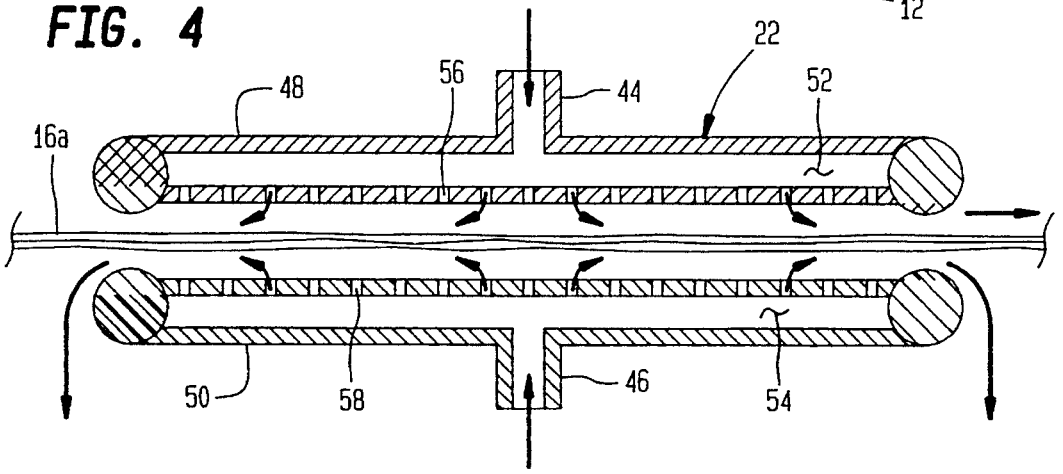
FIG. 4 is a side elevation section view of the flood box of FIG. 2.

The web **16*a* passes between the upper and lower panels 48 and 50 of a flood plate 22 as best seen in FIGS. 1, 2 and 4. This flood plate 22 serves to completely saturate the web 16*a* as it passes therethrough. To accomplish this liquid saturation, as best seen in FIGS. 1 and 2, a collecting tank 24 holding a quantity of liquid, the contents of which will typically be water in combination with a dermicide in preselected concentration, is pumped from the bottom of the tank at 40 by pump 38 upwardly into inlets 44 and 46 of the upper and lower panels 48 and 50, respectively. This liquid is pressurized, typically at about 20 p.s.i., into an interior volume 52 and 54 of the upper and lower panels 48 and 50, respectively. Small distribution ports 56 and 58 distribute the liquid in the direction of the arrows against the web 16***a* so as to completely saturate the web 16*a*. Excess liquid then falls downwardly by gravity in the direction of the arrows back into the collecting tank 24. To enhance excess liquid flow from the flood plate 22, the entire flood plate 22 is positioned at a slight incline or acute angle E as best seen in FIG. 2.

This apparatus 10 provides for the careful monitoring and flow of liquid so as to insure that both proper mixing and content or makeup of the liquid itself and to insure that a predetermined amount and concentration of liquid is being placed into the end product. To accomplish this, initially an array or assembly of three squeeze rolls 62 is provided through which the completely saturated web is passed. By appropriate control of the downward pressure which the central roller exerts in the direction of the arrow, the amount of liquid which is squeezed from the saturated web falling back into the collecting tank is regulated. The central roll 62*a* is preferably rubber coated, while the lower pair of support rolls 62*b* and 62*c* of the squeeze roll array 62 are fabricated of stainless steel.

The additional means for regulating the moisture content of the end product is accomplished through careful regulation and monitoring of the amount of liquid, mixed in regulated fashion, which is delivered and maintained within the collecting tank 24. A sight gauge 60 is provided so as to carefully monitor the liquid level within the collecting tank. Statically, the liquid level will raise to Wa, while during operation, the liquid level within the collecting tank 24 will drop to Wb. If these levels, as observed through sight gauge 60, vary significantly, there will be a clear indication of either over or under saturation of the web as it passes from the flood plate 22 through the squeeze roller arrangement 62 or incorrect fluid replenishment as will be described herebelow.

The degree of liquid content is controlled on an ongoing basis by providing a pair of positive displacement pumps 31 and 33 which deliver liquid (water and a liquid dermicide) through inlets 30 and 32 into a mixing chamber 26. This mixing chamber 26 receives some fluid by gravity from an outlet 28 of collecting tank 24. Separately, two positive displacement pumps 31 and 33 introduce preselected amounts of water and a dermicide from separate supply tanks (not shown) into the mixing chamber 26 at 30 and 32. The properly metered and mixed liquid is then drawn from outlet 34 by pump 36 from the mixing chamber 26 to be reintroduced through inlet 37 of collecting tank 24.

The wet, dripless web 16*b* leaving the squeeze roller array 62 thus now contains the preselected desired quantity of liquid. A driving roller 66, acting on drive belts 67 and 68, transport the wet, dripless web 16*b* in the direction of arrow B. By properly selecting the diameters of these various roller elements, including driven roller 70, an increasing linear feed rate is accomplished as the web 16*b* approaches the grooved cutting block 76. Conveyor belt 68 may be of a continuous or preferably segmented nature as desired.

The web 16*b* is thus transported in the direction of arrow B beyond cutting block 76 so that a preselected length of the web 16*c* extends onto conveyor belt 82. The conveyor belt 82, moving in the direction of arrow C, facilitates transporting the desired length of web 16*c* beyond the cutting block 76. A pneumatic cylinder 80 pivotally mounted at its upper end, exerts downward pressure through shoe 78 against the web portion 16*c* to both properly regulate the length of web portion 16*c* and to stabilize that web portion 16*c* during the cutting operation.

After the proper length of web portion 16*c* is in position as shown in FIG. 1, a high speed circular cutter 74 supported on a band cylinder 72 then slices or cuts the web to disconnect web portion 16*c* from web portion 16*b*. The web portion 16*c*, thus containing a plurality (here shown eight) of individual wet, dripless disposable towels, is conveyed to a sealed packaging area (not shown).

It is important to note that the entire apparatus 10 functions on an incremental, rather than a continuous basis. Thus, drive roller 66 rotates incrementally a predetermined amount so as to effect positioning a preselected and consistent length of web portion 16*c* ready for detachment by rotary cutter 74. Likewise, the positive displacement pumps 31 and 33 incrementally deliver a preselected amount of water and liquid dermicide into the mixing chamber 26 so that sight gauge 60 may be utilized to carefully monitor the liquid level Wa or Wb within the collecting tank 24 so as to insure a consistent level of moisture content and makeup of the end product.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. An apparatus for preparing stacks of individual liquid containing disposable towels ready for packaging comprising:

means for rollably supporting a plurality of continuous rolls of disposable towel stock and for guiding each free end drawn from each roll of said plurality of rolls together and aligned edgewise to form a web;

means for saturating said web with a liquid to produce a liquid saturated web portion;

means for controlledly squeezing excess said liquid from said liquid saturated web portion to produce a wet, dripless web portion;

means for collecting excess liquid squeezed from said liquid saturated web portion;

means for transversely cutting said wet, dripless web portion into generally rectangular, equally sized stacks of wet, dripless disposable towels ready for sealed packaging;

means for transporting said web incrementally from said supporting means through said cutting means.

2. A method of producing stacks of wet, dripless disposable towels ready for sealed packaging, each said stack including a plurality of individually separable disposable towels disposed one atop the other, comprising the steps of:

A. forming a web by aligning and bringing together a plurality of continuous lengths disposable towel stock, each towel stock length being pulled from one of a plurality of continuous rolls of towel stock supported on a creel;

B. saturating said web with a liquid suitable for assisting in moistening and cleaning skin to produce a liquid saturated web portion;

C. squeezing said liquid saturated web portion to remove some of said liquid therefrom to produce a wet, dripless web portion;

D. collecting excess said liquid squeezed from said liquid saturated web portion for reuse;

E. transversely cutting said wet, dripless web portion into equally sized generally rectangular stacks of wet, dripless disposable towels ready for sealed packaging.

3. An apparatus for preparing stacks of wet, dripless disposable towels ready for sealed packaging comprising:

a creel having laterally extending generally horizontal, parallel creel pins each structured to rollably support a separate continuous roll of disposable towel stock;

a guide for edge aligning and merging together all lengths of disposable towel stock being pulled from each said roll to form a web;

a generally horizontal flood box having an open central area through which said web is drawn;

a source of liquid connected to said flood box and in fluid communication with said open central area for saturating said web within said flood box to form a liquid saturated web portion;

a set of squeeze rollers for passing said saturated web portion therethrough to squeeze excess liquid from said liquid saturated web portion to form a wet, dripless web portion;

a collecting tank positioned below said flood box and said set of squeeze rollers for collecting liquid falling from said flood box and said set of squeeze rollers for reuse;

a cutting means for transversely cutting said wet, dripless web portion into generally rectangular, edge aligned equally sized stacks of wet, dripless disposable towels ready for sealed packing;

web transport means for incrementally drawing said web, in sequence, from said creel, through said flood box and through said squeeze rollers, beyond said cutting means a distance equal to a length of said stacks;

means for holding said wet, dripless web portion on either side of said cutting means during transverse cutting of said wet, dripless web portion into said stacks.

4. An apparatus as set forth in claim 3, wherein said flood box includes:

two spaced apart panels each defining an interior volume into which said liquid is pumped under pressure;

each panel having a perforated inner distribution plate facing said web from which said liquid flows to saturate said web;

said panels spaced apart sufficiently to allow said web to be freely drawn therethrough and to allow excess liquid to flow from therebetween and to fall by gravity into said collecting tank.

* * * * *